US006116466A

United States Patent [19]

Gueret

[11] Patent Number: 6,116,466

[45] Date of Patent: Sep. 12, 2000

[54] TWO-PRODUCT DISPENSING UNIT

[75] Inventor: Jean-Louis H. Gueret, Paris, France

[73] Assignee: L'Oreal S.A., Paris, France

[21] Appl. No.: 09/166,130

[22] Filed: Oct. 5, 1998

[30] Foreign Application Priority Data

Oct. 3, 1997 [FR] France ..... 97 12348

[51] Int. Cl.[7] ..... B65D 35/22

[52] U.S. Cl. ..... 222/94; 222/95; 222/145.3; 222/321.7; 222/386.5; 222/395; 222/402.18

[58] Field of Search ..... 222/94, 95, 105, 222/145.3, 321.7, 386.5, 389, 395, 402.18

[56] References Cited

U.S. PATENT DOCUMENTS

| | | | |
|---|---|---|---|
| 3,338,479 | 8/1967 | Marraffino | 222/193 |
| 3,550,813 | 12/1970 | Lehmann | 222/94 |
| 3,591,088 | 7/1971 | Green | 239/304 |
| 3,598,290 | 8/1971 | Steiman | 222/94 |
| 4,585,149 | 4/1986 | Zulauf | 222/94 |
| 5,516,004 | 5/1996 | Lane | 222/402.18 |
| 5,526,957 | 6/1996 | Brown et al. | 222/402.18 |
| 5,730,326 | 3/1998 | Kaeser | 222/402.18 |

FOREIGN PATENT DOCUMENTS

| | | |
|---|---|---|
| 0 410 858 | 1/1991 | European Pat. Off. . |
| 0 737 629 | 10/1996 | European Pat. Off. . |
| 2 615 826 | 12/1988 | France . |
| 2 629 058 | 9/1989 | France . |

OTHER PUBLICATIONS

English Language Derwent Abstract of EP 0 410 858.
English Language Derwent Abstract of EP 0 737 629.
English Language Derwent Abstract of FR 2 615 826.
English Language Derwent Abstract of FR 2 629 058.

*Primary Examiner*—Joseph A. Kaufman
*Attorney, Agent, or Firm*—Finnegan, Henderson, Farabow, Garrett & Dunner, L.L.P.

[57] ABSTRACT

A dispenser is provided for dispensing through at least one outlet at least two products. The dispenser includes a container for containing a first product, and a dispensing member extending from the container. The dispensing member is capable of being actuated to permit flow of the first product from the container. The dispenser is provided with an actuation control element. The actuation control element controls actuation of the dispensing member and defines a reservoir for containing a second product, and first and second flow paths in flow communication with at least one outlet of the dispenser. The first flow path includes at least one passage in flow communication with the dispensing member for conveying the first product, and the second flow path is in flow communication with the reservoir for conveying the second product. The reservoir is configured so that pressure of the first product flowing from the container causes flow of the second product through the second flow path. The dispenser also includes a flow controlling member mounted between the dispensing member and the actuation control element. The flow controlling member is configured to regulate flow of the first and second products.

37 Claims, 5 Drawing Sheets

TWO-PRODUCT DISPENSING UNIT

The present invention relates to a device for the simultaneous dispensing of two products packaged separately. More particularly, the invention is directed to dispensing certain products used in cosmetics, pharmaceuticals or dermopharmacology. The invention is aimed, in particular, at dispensing products which, for reasons of stability, cannot be brought into contact with one another until the moment of use. For example, the invention could be practiced to dispense active agents, such as vitamin C, A or E, bicarbonate, or fruit acids, such as citric acid, together with a moisturizer in the form of a gel, a cream or a gel-cream.

FR-A-2,615,826 describes a device for dispensing a mixture of a pasty substance and at least one pasty additive, especially in the form of a striped bead. The device comprises a container, especially a tube with flexible walls, containing a first pasty product. The container is surmounted by a neck on which a dispensing head is mounted. The dispensing head has a body, an annular part of which forms a reservoir for a second product, capable of leaving through an outlet orifice, under the thrust of the first product. The body also defines a central passage for conveying the first product towards the outlet orifice, so as to form a striped bead containing a little of both products. According to one alternative form illustrated in this document, the second product is contained in a central part of the body of the dispensing head, and the first product is conveyed by an annular passage. The respective flow rates of each of the products are determined to a great extent by the diameter of the neck of the flexible-walled container, and by the configuration of the body of the dispensing head, etc. Thus, if one wishes to produce such a system with different flow rate characteristics, this entails changing the body of the dispensing head, and therefore investing in an expensive mould. In one of the embodiments disclosed in this reference, the body containing the second product has an attached bottom, but the configuration of the bottom is such that it does not in any way alter the flow of product leaving the flexible-walled tube. It therefore has no effect on the respective flow rates of each of the products.

FR 2,629,058 describes a device comprising means for varying the respective flow rates of each of the products. Typically, the flow rates are adjusted at the outlet from the device, by varying the angular position of a dispensing spout relative to a cap; and this has the effect of altering the cross-sections of the orifices through which the products leave. A device of this kind has the drawback of being relatively complicated and expensive to manufacture.

In one of the embodiments of EP-0,410,858, there is described a system in which the closure of the outlet orifice is achieved by means of an elastically deformable member including a lip, capable of moving from a closed position in response to pressure of a product in order to allow the product to pass, and of returning to the closed position, with or without taking in air, as soon as the pressure ceases.

These dispensing devices disclosed in these references have an number of drawbacks and disadvantages. For example, it is difficult to alter the flow rate of substances dispensed from these dispensers without making complex and expensive manufacturing variation. Therefore, there is a need in the art for an improved dispenser.

Accordingly, the present invention is directed to a dispenser that substantially obviates one or more of the limitations of the related art. In particular, the present invention is directed to a device for dispensing two products packaged separately, which preferably has structure that is simple and economical to produce, for determining the respective flow rates of each of the products.

One preferred object of the invention is to produce a device in which the adjustment of the respective flow rates of each of the products does not require the entire dispensing head to be changed.

Another preferred object of the invention is to provide a dispensing head comprising a molded thermoplastic body, in which altering the respective outlet flow rates of the products does not require altering the body of the dispensing head.

A further preferred object of the invention is to produce a device that can be fitted onto a container, in which the dispensing of the product is controlled by a manually-operated pump or by a valve, having an outlet stem, the outside diameter of which is very small (typically smaller than about 5 mm, and generally of the order of about 2 mm to about 3 mm).

It should be understood that the invention could still be practiced without performing one or more of the preferred objects and/or advantages set forth above. Still other objects will become apparent after reading the following description of the invention.

To achieve these and other advantages and in accordance with the purpose of the invention, as embodied and broadly described herein, the invention includes a dispenser for dispensing through at least one outlet at least two products. The dispenser includes a container for containing a first product, and a dispensing member extending from the container. The dispensing member is capable of being actuated to permit flow of the first product from the container. The dispenser is provided with an actuation control element. The actuation control element controls actuation of the dispensing member and defines a reservoir for containing a second product, and first and second flow paths in flow communication with at least one outlet of the dispenser. The first flow path includes at least one passage in flow communication with the dispensing member for conveying the first product, and the second flow path is in flow communication with the reservoir for conveying the second product. The reservoir is configured so that pressure of the first product flowing from the container causes flow of the second product through the second flow path. The dispenser also includes a flow controlling member mounted between the dispensing member and the actuation control element. The flow controlling member is configured to regulate flow of the first and second products.

In another aspect of the invention, a packaging and dispensing unit is provided. The unit includes a dispensing member having an elastic return and a hollow stem mounted on the elastic return and extending from a first container. The unit also includes an actuation control element including a body having a reservoir containing a second product capable of leaving the reservoir via a first orifice in response to pressure of the first product, and at least one passage in flow communication with the hollow stem for conveying the first product under pressure toward the second orifice. The unit further includes a flow controlling member mounted between the hollow stem and the actuation control element. The flow controlling member is configured to interact with the flow of the first product to determine the respective outlet flow rates of the first and second products.

In a further aspect of the invention, the actuation control element includes a body consisting of a single molded piece of material, especially a thermoplastic such as polypropylene, polyethylene terephthalate, or polyethylene, etc.

In another aspect, the first product A pushes the second product B via a moving piston. This avoids the products A and B from being kept in contact with one another, something which may be essential in the case of certain product pairings.

In yet another aspect, respective flow rates of products are determined, at least in part, by a flow controlling member (this is also be referred to as an intermediate member) which is separate from the body of the dispensing head. The member furthermore allows the unit to be fitted in a leak-tight manner onto the hollow stem (of a pump or valve for example). This intermediate member, situated between the container containing the first product and the reservoir containing the second product, makes it possible, as appropriate, to make the molding of the body considerably easier and, as a consequence, to reduce its cost of manufacture. Put another way, the same body can be used for dispensing pairs of products with different respective flow rates, simply by changing the intermediate member. The intermediate member may also be obtained by moulding, which moulding is, in terms of cost, nowhere near as expensive as the additional cost which would be entailed in manufacturing a head body mounted directly on the hollow stem and incorporating all the elements needed for distributing the flows of product A in the head in order to alter the respective flow rate of each of the products. Furthermore, the possibilities for adjusting the respective flow rates are appreciably more numerous than would be possible if the flow splitter formed an integral part of the body of the dispensing head, this being merely by altering the configuration of the ducts, passages or orifices formed by the intermediate piece.

Preferably, the device can be fully emptied, regardless of the ratio of the respective flow rates of each of the products.

In still another aspect, the body may be surmounted by an element (cap member) closing the body and forming a bearing surface to allow actuating pressure to be exerted. Preferably, the outlet orifice(s) of the dispenser are provided in the element. This element may be mounted by snap-fitting, bonding, welding or any other appropriate means.

According to a first embodiment, the product A is pressurized in the first container, and the dispensing member includes a valve. Preferably, the product A is pressurized using a liquefiable or non-liquefiable gas, or by means of a piston pushed by a gas for example. Alternatively, the dispensing member includes a manually-actuated pump.

In one embodiment of the invention, the reservoir for product B may be an annular part of the body, and the product A is conveyed towards the second orifice via a central conveying passage.

In one other aspect, the body has a fixed annular bottom including at least one orifice for allowing the body to communicate with the hollow stem. Preferably, the reservoir has a moving bottom in the form of an annular piston capable of moving axially under the thrust of the product A, wherein the moving bottom is axially separated from the fixed bottom. The presence of the piston is not essential, particularly when the issue is one of dispensing products of very pasty consistency.

In an even further aspect, the central conveying passage is raised up off the fixed annular bottom and supported by bridges of material spaced angularly around the orifice. The bridges have a first end secured to the annular bottom and a second end secured to the conveying passage.

According to a first embodiment, the intermediate (flow controlling) member has an inlet orifice communicating with the hollow stem distributing the product A both directly into the central conveying passage and under the annular piston between the fixed bottom and the annular piston. Thus, in this embodiment, the intermediate member allows the production of a wider central passage in the body of the actuation control element, while allowing mounting on the small-diameter hollow stem.

Furthermore, with this embodiment, it is possible to use the product A directly leaving the container in which it is packaged.

According to a second embodiment, the intermediate member has an inlet orifice communicating with the hollow stem and a part facing the inlet orifice being capable of forming a deflector for the product A so as to convey it both into the central conveying passage and under the annular piston via lateral passages lying between bridges of material supporting the deflector. Thus the flow of product A passing through the central duct and the flow of product A pushing the annular piston are both regulated at once. Furthermore, like in the previous embodiment, this makes it possible to make the central passage wider. Orifices or slits may be provided at the base of the central hollow tube, which orifices may, at the beginning of the use of the device, be situated facing the piston, but which will be uncovered after the piston has moved up slightly, thus allowing the flow into the central conveying passage to be increased.

Another type of regulation is obtained with an embodiment in which the intermediate member has an inlet orifice communicating with the hollow stem and a portion capable of closing, completely or partially, the orifice in the fixed bottom of the body. In this embodiment, the product A is conveyed both into the central conveying passage and under the annular piston via lateral passages lying between the fixed bottom and the intermediate member and via orifices made in the fixed bottom of the body near the periphery of the body. Apart from widening the central passage, the intermediate piece according to this embodiment makes it possible to make the product A pass around the periphery, under the annular piston. This embodiment is advantageous in that it allows air to be expelled, particularly in the case of a highly viscous product A.

Preferably, the portion capable of closing the central orifice may be supported by one or more bridges of material spaced angularly so as to allow the product A to pass into the lateral passages.

In an alternative embodiment, the reservoir for the second product B is in a central part of the body, and the first product A is conveyed towards the second orifice via an annular conveying passage surrounding all or part of the central reservoir.

In this alternative embodiment, the intermediate member may have an inlet orifice communicating with the hollow stem and arranged in such a way as to distribute the product A in a central flow intended to push the product B and in a lateral flow along lateral passages for feeding the annular conveying passage. The lateral flow enters the annular conveying passage through slits or orifices in an annular bottom of the conveying passage. The central flow rate under the product B is thus reduced, in order to increase the passage of the product A through the annular region.

In another aspect, orifices or slits are provided in the central part of the body to communicate with the annular conveying passage in such a way that they generate second lateral flows to feed the annular conveying passage. Thus the flow of product A leaving via the annular passage is increased. Furthermore, on priming, the piston expels the residual air lying beneath it, via the slits or orifices of the central passage.

Preferably, the actuation control member is mounted on a cover band. The cover band may be moulded as one piece with the flow control member or with the actuation control member, and the band may be connected to the actuation control member by frangible bridges of material. The bridges of material may be broken at the time of first use, thus making the system tamperproof.

In yet another aspect, the product A may be contained in a pouch made of flexible material. For example, the pouch is made of a sheet of aluminium, or a complex of several different materials. Preferably, the pouch is contained inside a rigid or semi-rigid casing.

Preferably, the first and second flow paths for the products open into a single outlet orifice, or into two distinct outlet orifices.

Particularly in the case of a single outlet orifice, the orifice may be closed by an elastically deformable member capable of moving from a closed position in response to the pressure of the products to allow the product to leave, and of returning to the closed position when the pressure ceases. Preferably, the elastically deformable member is a lip made of elastomeric material.

The ratio of the flow rate of the second product to the flow rate of the second product (B/A) preferably varies depending on the products and applications. By way of example, the ratio of flow rates B/A varies from about 5/95 to about 50/50, preferably from 5/95 to 50/50.

Preferably, the intermediate member is mounted on the hollow stem via a sleeve. At least part of the external surface of the hollow stem and/or the internal surface of the sleeve has striations, such as grooves) capable of allowing air to be expelled. This function of expelling air is quite particularly advantageous when the dispensing head is removable.

According to a preferred embodiment, the actuation control member is force-fitted onto the intermediate member. Other means may be used for mounting the actuation control member on the intermediate member.

By way of example, the products A and B are cosmetic, pharmaceutical or dermopharmaceutical compositions.

It is to be understood that both the foregoing general description and the following detailed description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1 is a cross-section view of a first embodiment of a two-product packaging and dispensing unit according to the invention;

Figure 1:
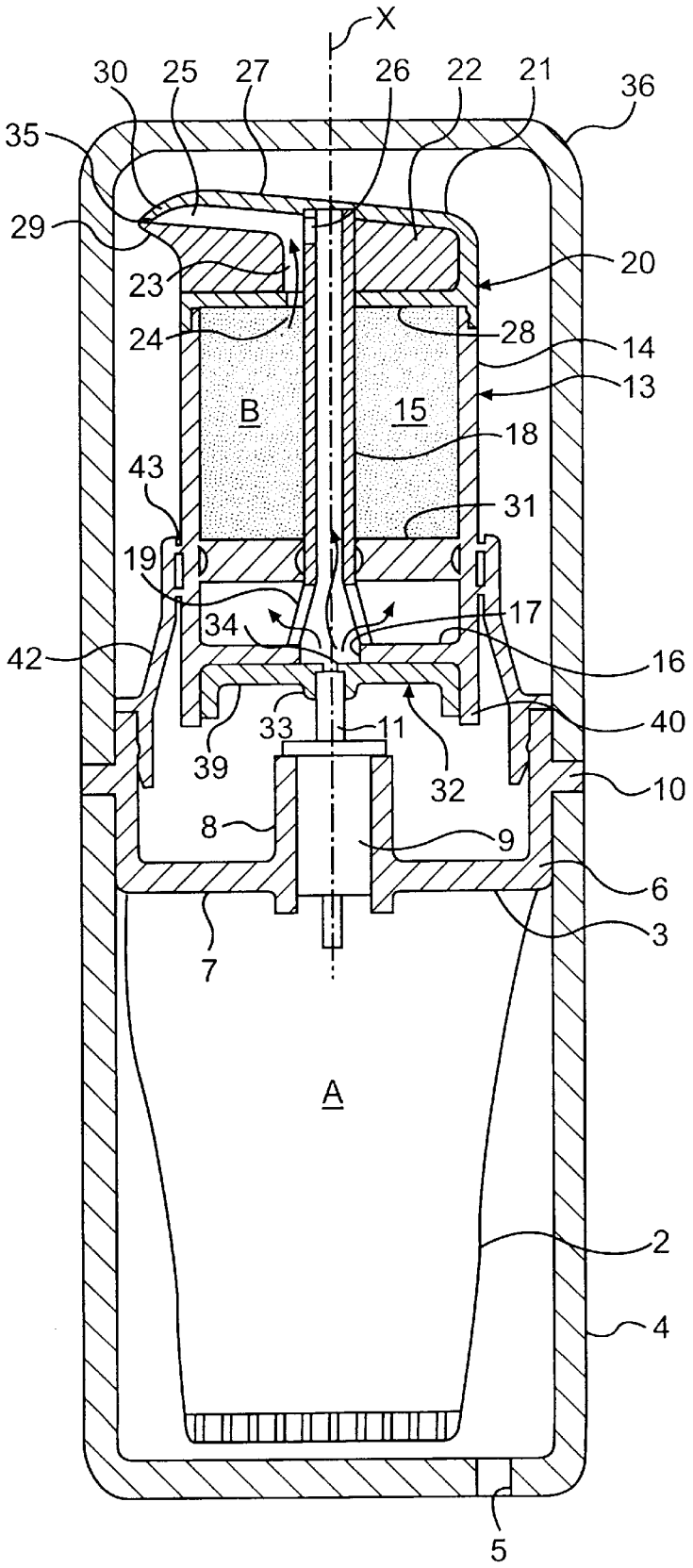

Reference will now be made in detail to the present preferred embodiments of the invention, examples of which are illustrated in the accompanying drawings. Wherever possible, the same reference numbers are used in the drawings and the description to refer to the same or like parts having similar structural configuration(s) and/or function(s).

FIG. 1 shows an embodiment of a dispensing and packaging unit 1. The unit 1 comprises a container 2 for containing a first product A. In this embodiment, the container 2 is a pouch made of flexible material, preferably aluminium, inside of which there is the first product A (for example in the form of a cream). The product A may be a moisturiser in the form of a gel in the aqueous or hydro-alcoholic phase, a water-in-oil or oil-in-water cream, a gel-cream or composition in an anhydrous phase.

A free edge of the pouch is bonded or welded to a pouch head 3 mounted on the free end of a rigid or semi-rigid casing 4, which at its bottom has an orifice 5 for taking in air. The pouch head 3 has an annular skirt 6 including an annular edge 10 intended to bear against the free edge of the rigid or semi-rigid casing 4. The skirt 6 is force-fitted into the opening in the casing 4 so that an annular end 7 of the pouch head 3 closes the opening. The pouch head 3 has a central hollow tube 8 communicating with the container 2.

A dispensing member 9 is mounted on the hollow tube 8. The dispensing member 9 extends from the container 2 and is capable of being actuated to permit flow of the first product A from the container 2. In the embodiment shown in FIG. 1, the dispensing member 9 is a manually-actuated pump. The pump 9 may be mounted by crimping, via an intermediate piece (not shown) which may be snap-fastened inside the central hollow tube 8.

An actuation control element or dispensing head 13 is mounted on a hollow stem 11 of the pump 9 by means of a flow controlling member 32, the function and characteristics of which will be described in greater detail later. The dispensing head 13 comprises a body 14 having an axis X. Preferably, the body 14 is a molded single piece of plastic, such as polypropylene, for example. The body 14 defines a reservoir for containing a second product B. As shown in FIG. 1, the body 14 has an annular region 15 containing a second product B, for example an active agent, to be dispensed in combination with the product contained in the container 2. The product B may consist of a product in the anhydrous phase, a cream or a gel containing active agents such as vitamin C, A or E, bicarbonate or fruit acids.

The body 14 has a fixed annular bottom 16 including an axial opening 17. A central hollow tube 18 is supported by three tabs 19 arranged uniformly around the opening 17, so as to allow the first product A to pass between the said tabs 19.

A cap member or cap 20 is fitted in such a way as to close the body 14 and define a bearing surface 21 to allow the pump 9 to be actuated. The cap 20 is snap-fitted onto the free edge of the body 14. The central hollow tube 18 is of such an axial height that when the cap 20 is fitted, the central hollow tube 18 is in contact with the internal surface of the transverse wall 27 of the cap forming the bearing surface 21. An elastomeric member 22 is placed inside the cap 20, and together with the body of the cap 20 defines an axial passage 23 communicating with the annular region 15 via a slit or an orifice 24 made in a transverse wall 28 of the cap 20. The axial passage 23 opens into a radial passage 25, also communicating with the central hollow tube 18 via a slit or an orifice 26 made in the wall of the central hollow tube 18 near its upper edge. The radial passage 25 opens into a spout where the elastomeric member forms a lip 29. In the position of rest, the lip 29 bears elastically against a corresponding edge formed by the transverse wall 27 of the cap 20, and this edge forms a seat 30 for the lip 29. Under the pressure of the product(s), the lip 29 moves away from the seat 30 to allow the product to pass. When the pressure ceases, the lip 29 comes back to bear in a leak-tight manner against the rigid seat 30.

Two separate flow paths are formed in the dispensing head (actuation control element) 13. A first flow path for the first product A includes the passage in the hollow tube 18 and the slit or orifice 26. A second flow path for the second product B includes the slit or orifice 24 and the axial passage 23 in flow communication with the region (reservoir) 15 for the second product B. In the embodiment shown in FIG. 1, the first and second flow paths open into the radial passage 25 to form a common dispensing outlet for both the first and second products A and B. Alternatively, each flow path has a separate dispensing outlet.

The annular region 15 is closed by a moving bottom in the form of a piston 31 capable, in response to pressure of the product A, of pushing the product B in the direction of the orifice 24. The annular piston 31 is spaced axially from the bottom 16, so as to allow the product A to pass through the annular space that lies between the fixed bottom 16 and the piston 31, so as to push the piston 31. When the first product pushes the piston 16, the second product flows through the second flow path including the slit or orifice 24 and the axial passage 23.

The flow controlling member 32 is preferably a member separate from both the dispensing head (actuation control member) 13 and the dispensing member 9. The intermediate member 32 is mounted to both the dispensing member 13 and the hollow stem 11 of the dispensing head 13 so that the intermediate member is between the dispensing member 13 and the dispensing head 13. The intermediate member 32 has a structural configuration that controls or directs flow of the first product A flowing from the container 2. Because the flow of the first product A causes flow of the second product B, the intermediate member 32 also indirectly controls flow of the second product B.

The intermediate member 32 comprises a transverse wall 39 connected to an annular edge 40 having an outside diameter slightly smaller than the inside diameter of the free edge of the body 14, so as to allow the body 14 to be force-fitted onto the intermediate member 32. A hollow tube 33 at the center of the intermediate member provides a sleeve having an inside diameter capable of being force-fitted on the pump stem 11. The hollow tube 33 opens onto an orifice 34 communicating with the hollow stem 11, and opening opposite the central orifice 17 in the fixed bottom 16. In the embodiment of FIG. 1, the dimensions of the orifice 34 regulate flow of the first product A flowing from the container 2 and this flow regulation also controls pressure exerted on the piston 31 to regulate the flow rate of the second product B.

A removable cap 36 covers the dispensing head 13. The dispensing head 13 also has a cover band 42. In this embodiment, the band 42 and the body 14 of the dispensing head 13 are molded together as a single piece. The band 42 is snap-fastened onto the pouch head 3. Before products are dispensed from the unit 1, the band 42 is connected to the body 14 by tabs 43 that can be broken, particularly at the time of first use, guaranteeing that the unit 1 is tamperproof before it is used for the first time.

To dispense the mixture, the user depresses the bearing surface 21 of the push-button 13, which depresses the pump stem 11 and causes product A to leave through the hollow stem, via the orifice 34 of the intermediate member 32. The product A passes, between the tabs 19 under the piston 31, which under the effect of pressure, causes the product B to leave through the orifice 24 and the passage 23. The product B is thus conveyed into the radial passage 25. At the same time, the product A passes into the central hollow tube 18 and emerges in the radial duct 25, where it mixes with product B. The thrust from the mixture causes the lip 29 to open and the mixture passes through the outlet orifice 35 defined by the lip and the seat. By releasing the pressure on the push-button 13, the pump stem 11 returns to the closed position by elastic return, thus interrupting the dispensing of the products A and B.

Alternatively, it is possible to provide two discharge passages 25 arranged side by side, and opening onto two adjacent discharges outlets, so as to cause the two products A and B to leave simultaneously, but separately. The discharge orifice or orifices may emerge laterally as in the embodiment illustrated, or parallel to the axis of the device.

The flow controlling member 32 (intermediate member) used for mounting the dispensing head 13 on the pump stem 11 makes it possible, in addition to providing sealing, to increase the flow rate of product A passing directly into the central duct 18, by making it possible for the latter to be given a larger cross-section than it could have if the push-button were mounted directly on the pump stem, especially owing to moulding and de-moulding constraints. Similarly, the flow of product needed for pushing the piston 31 and making the product B come out is reduced. Thus the ratio of flow rates B/A is reduced. Furthermore, the fragility of the central hollow tube is reduced.

Figure 2A:
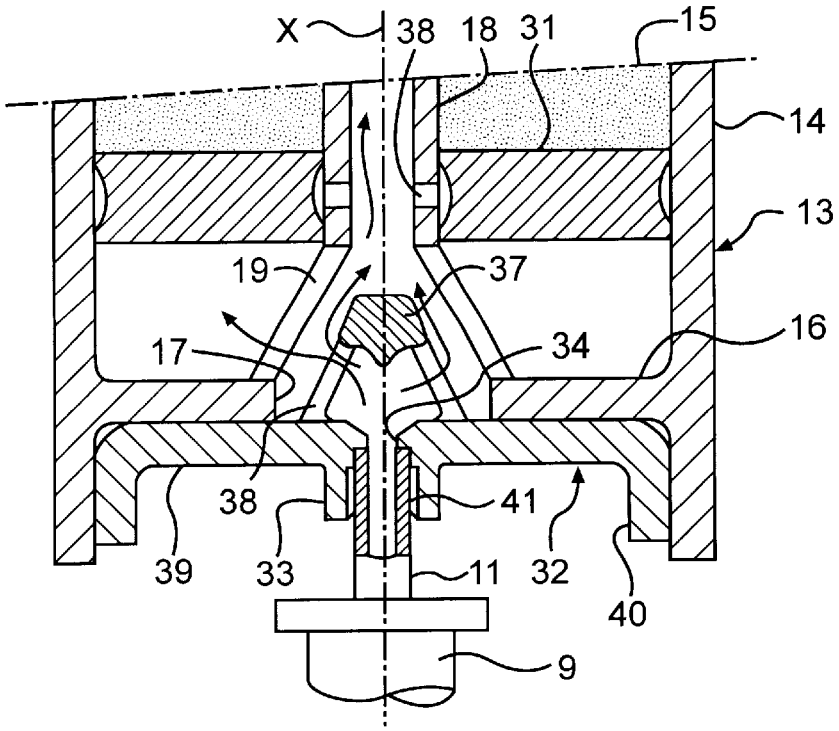
FIGS. 2A–2D are partial cross-section views showing different types of intermediate flow control members for use with the unit show in FIG. 1.

In the alternative embodiment shown in FIG. 2A, the intermediate member 32 bears, facing the orifice 34, a deflector 37 supported by tabs 38 angularly spaced all around the orifice 34. The flows of product A are illustrated in the drawing by arrows. The deflector 37 breaks the flow of product A leaving the pump stem and increases the flow of the product A that is directed laterally under the piston, thus increasing the thrust applied to the piston, and therefore the amount of product B dispensed. The flow of product B on priming is thus regulated. Advantageously, orifices or slits 38 at the base of the central hollow tube 18 and situated, prior to first use, facing the piston 31, are uncovered gradually as the piston rises. These orifices, once uncovered, actually allow the product A to pass from the annular passage towards the central duct 18, thus increasing the flow rate of product A in the central passage 18. In this embodiment, the internal surface of the axial skirt 33 has vertical striations 41, such as grooves, to allow air to be expelled as the dispensing head 13 is mounted on the pump stem. Striations 41 extend over the entire height of the stem or of the axial skirt 33, except for the top end, so as to allow the skirt to bear against the hollow stem in a leak-tight manner over about 1 mm. In the same way as in the previous embodiment, it is possible to produce a conveying duct 18 of greater or smaller cross-section, depending on the desired ratio of flow rates B/A.

Figure 2B:
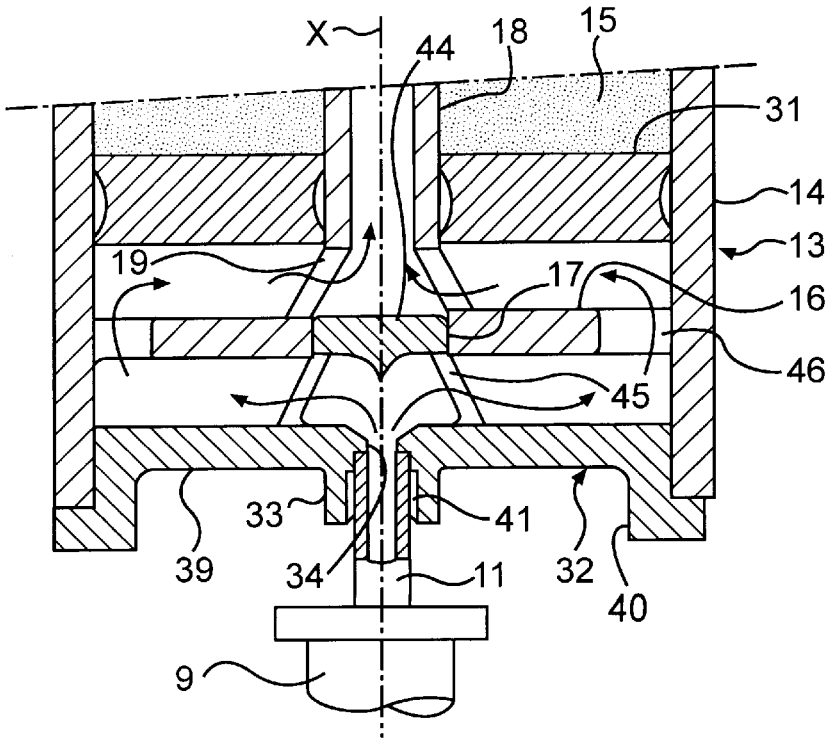

In the alternative embodiment shown in FIG. 2B, the fixed bottom 16 of the body 14 is axially separated from the transverse wall 39 of the intermediate member 32. Furthermore, the orifice 17 is closed off in a leak-tight manner by a blanking element 44 supported by angularly spaced tabs 45. Furthermore, passages or orifices 46 are made in the fixed bottom 16, near its periphery. Thus, product A leaves the hollow stem 11 via the orifice 34 of the intermediate member 32, passes under the fixed bottom 16, comes out into the body 14 via the peripheral orifices or slits 46. Once it is in the body, the product A, on the one hand, pushes the piston 31 and, on the other hand, passes into the central duct 18 between the tabs 19. This configuration advantageously allows air to be expelled, particularly on priming, especially if the product A is very viscous.

Figure 2C:
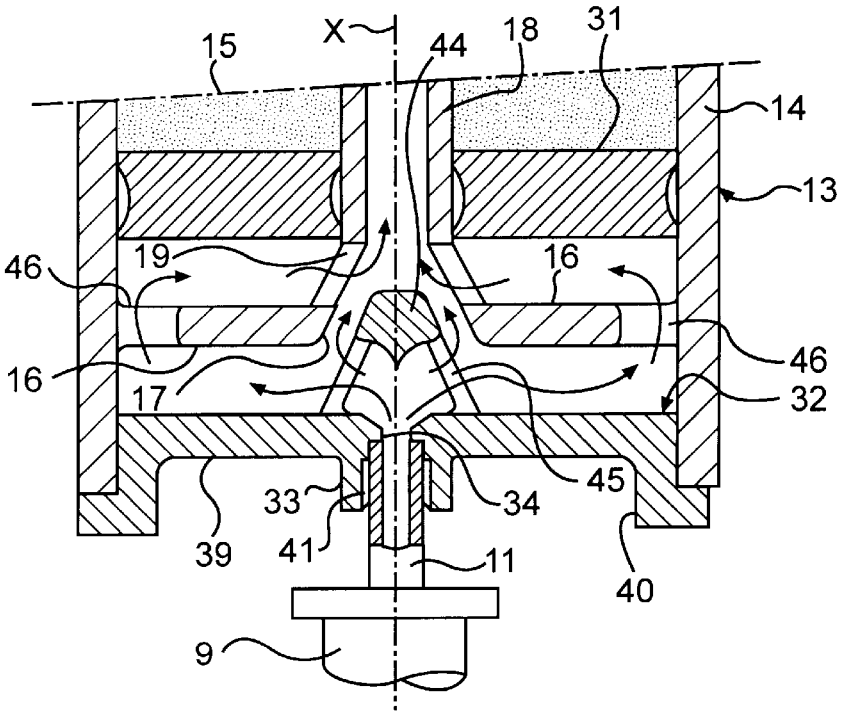

The alternative embodiment shown in FIG. 2C differs from the alternative embodiment shown in FIG. 2B in that the element 44 does not fully close off the orifice 17 in the bottom 16, which means that some of the product passes right around the element 44 to be conveyed into the central duct 18, the remainder of product A passing under the fixed bottom 16 and emerging under the piston 31 via the peripheral passages or orifices 46. Thus, compared with the previous alternative form, the flow rate of product A in the central duct 18 is increased. The amount of product passing into the annular space lying right around the element 44 depends on the width of the latter. By altering this width it is therefore possible to alter the respective flow rates of each of the products A and B.

Figure 2D:
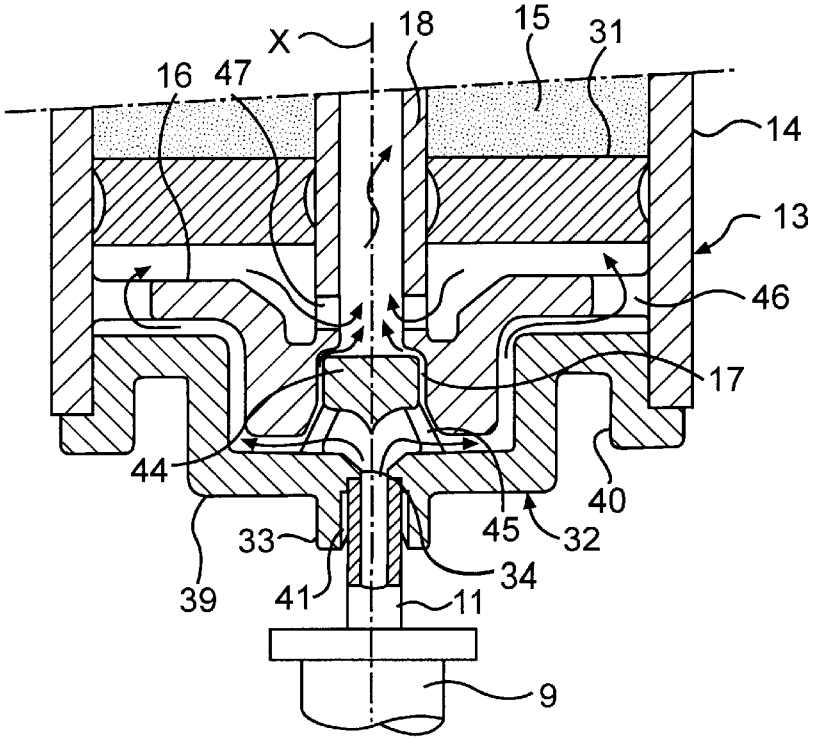

In the alternative embodiment of FIG. 2D, the flows of product A are appreciably identical to the flows of product A in the alternative form of the previous figure. However, the fixed bottom 16 of the body 14 has a profile which has an axial depression, similar to the one formed by the intermediate member 32, thus reducing the axial space that there is between the intermediate member 32 and the fixed bottom 16, and increasing the length of the path of the product A under the fixed bottom 16. Product A leaves the hollow stem 11 via the orifice 34 of the intermediate member 32, passes, on the one hand, into the central hollow tube 18, right around the element 44 and, on the other hand, under the fixed bottom 16, where it emerges into the body 14 via the peripheral orifices or slits 46. Once it is in the body, the product, on the one hand, pushes the piston 31 and, on the other hand, passes into the central duct 18 via orifices or slits 47 made in the lower part of the central hollow tube 18, near the fixed bottom. Thus, some of the product A passes more or less directly into the conveying duct 18, while another part passes first of all under the piston 31 before passing into the conveying duct 18. As can be seen, by altering the size, number and length of the passages, and their configurations, the respective flow rates of the products A and B can be changed. In actual fact, the number of variations is unlimited and allows very fine adjustments of the ratio of flow rates B/A.

Figure 3:
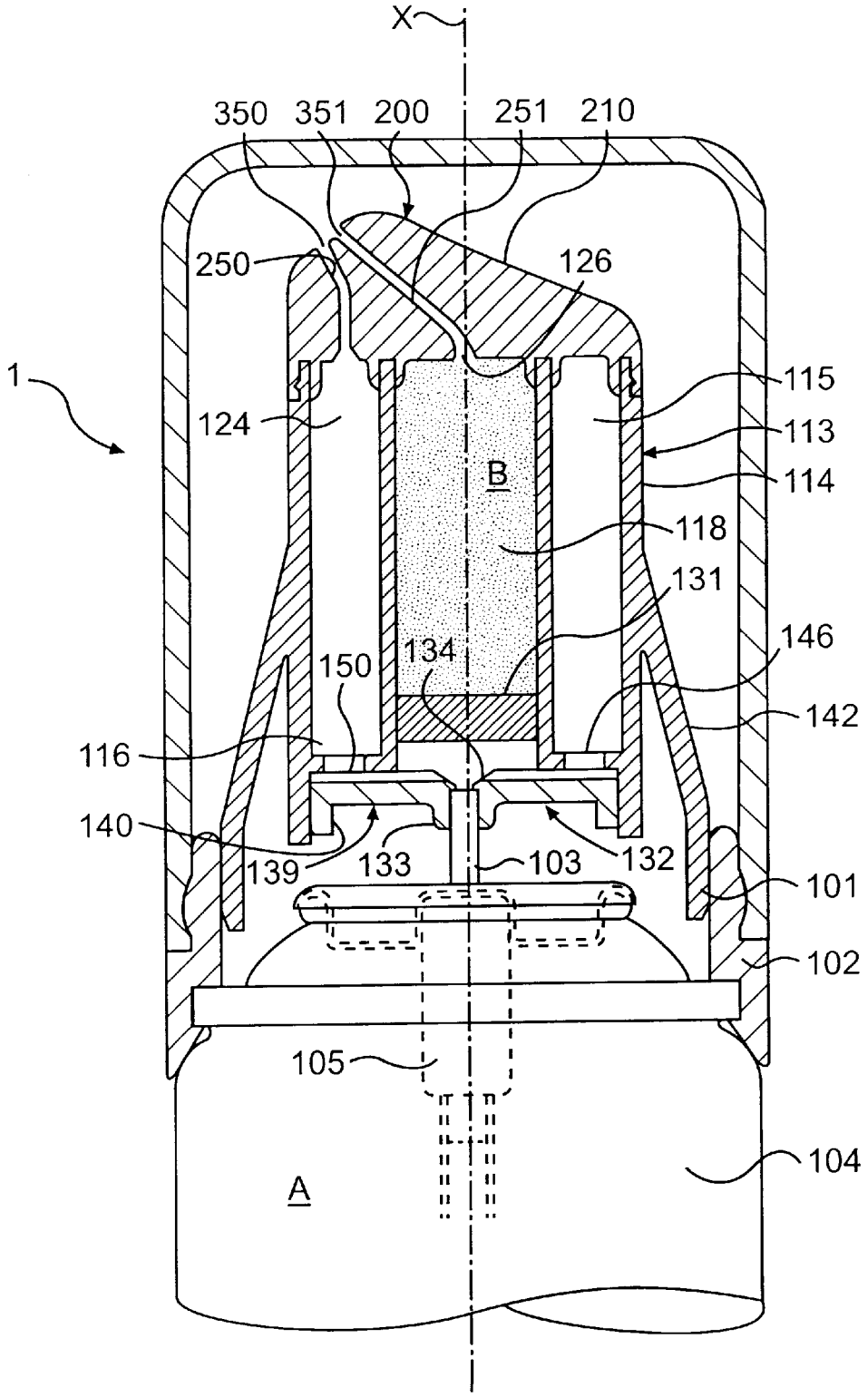
FIG. 3 is a partial cross section view of a second embodiment of a two-product packaging and dispensing unit according to the invention.

In the embodiment of FIG. 3, the body 114 of the dispensing head (actuation control element) 113 has a central passage (reservoir) 118 in which the product B is located. The central passage 118 is at the bottom closed off by a moving bottom 131 in the form of a piston. The body 114 defines an annular region 115 intended for the passage of the product A. The body 114 is closed at its top by a cap 200, an inclined surface 210 of which defines a bearing surface for actuating a dispensing member 105. As shown in FIG. 3, the dispensing member 105 is a valve mounted on a container 104, such as an aerosol type, containing a pressurized amount of product A. The valve 105 is provided with a hollow valve stem 103 extending from the container 104. The cap 200 has two ducts 250, 251 opening to two adjacent outlet orifices 350, 351. The first duct 251 communicates with the central duct 118 via an orifice 126. The second duct 250 communicates with the annular region via an orifice 124. The two outlet orifices 350, 351 are located close together so as to make it easier for the two dispensed products to be collected simultaneously. The annular region has a fixed annular bottom 116 pierced with an annular slit 146 or with a number of slits or orifices uniformly arranged in the periphery of the bottom 116. A band 142 is secured to the body and has a free edge 101 capable, when the valve 105 is actuated, of sliding inside a skirt 102 snap-fastened onto the edge of the container 104. The body 114 of the dispensing head 113 is mounted on the valve stem 103 via an intermediate flow control member 132 which also acts as a flow controller or splitter for product A, so as to determine the ratio of flow rates B/A.

In this embodiment, the intermediate member 132 comprises a transverse plate 139 bearing an axial skirt 133 forming a sleeve of a diameter that is appropriate to allow it to be force-fitted onto the valve stem 103. The axial skirt 133 opens onto an outlet orifice 134 lying opposite the moving piston 131. The body 114 of the dispensing head 113 is force-fitted onto the intermediate member 132, via a lateral skirt 140 interacting in a leak-tight manner with the internal surface of the free edge of the body 114, the plate 139 being in contact with the fixed annular bottom 116. The top surface of the transverse plate 139 has ducts 150 extending radially from the orifice 134 as far as the periphery of the intermediate member 132 so as to communicate with the annular passage 115 via the slits or orifices 146. The ducts are uniformly spaced over the entire surface of the intermediate member 132.

To use the unit with a view to simultaneously dispensing products A and B, the user presses on the surface 210, depressing the valve stem 103. The pressurized product leaves via the hollow stem 103 and comes out into the body 114 of the dispensing head 113 through the orifice 134 made in the plate 139 of the intermediate member 132. A first part of the product A pushes the central piston 131 and causes the product B to leave through the outlet orifice 351. The rest of the product A passes into the radial ducts 150, under the annular bottom 116, and emerges in the annular passage 115, via the slits or orifices 146. The product A leaves via the outlet orifice 350 at the same time as the product B. When the actuating pressure on the surface 210 ceases, the valve stem 103 goes back to the closed position, by elastic return, and this interrupts the dispensing of the products A and B.

In the same way as for the other embodiment, mounting the dispensing head 113 on the valve stem 103 via an intermediate member 132 gives a free choice of respective cross-sections for the central duct 118 and for the annular passage 115, independently of the cross-section of the valve stem 103. Furthermore, the ratio of the respective flow rates is adjusted, particularly by altering the dimensions and number of radial passages 150 and orifices 146.

Figure 4A:
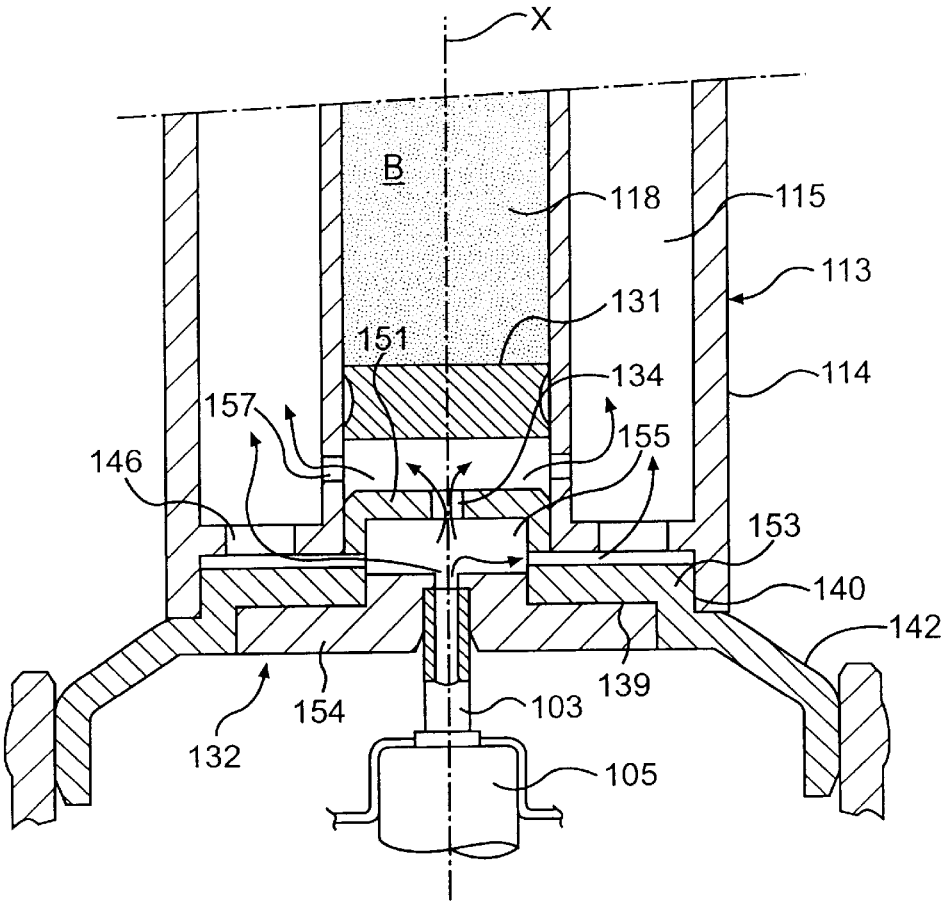
FIG. 4A is a partial cross-section view showing an alternative embodiment similar to that of FIG. 3.
Figure 4B:
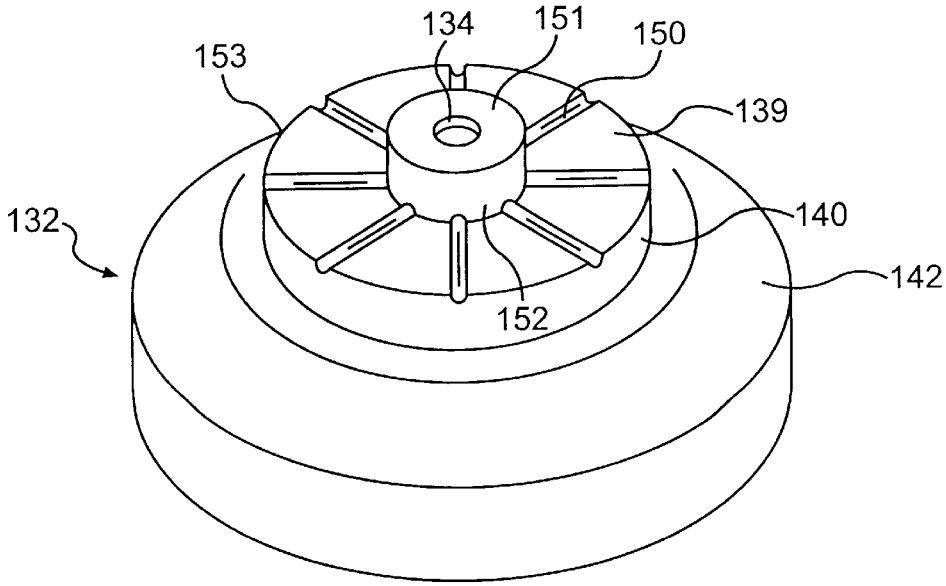
FIG. 4B is a perspective view of a flow controlling member (intermediate member) for the embodiment of FIG. 4A.

In the alternative embodiment shown in FIGS. 4A and 4B, the intermediate flow control member 132 has a radially extending skirt formed by molding the element 132 and a cover band 142 in one piece. As shown in FIG. 4A, the intermediate member 132 consists of two parts 153, 154, force-fitted together. The first part 153 comprises a transverse annular plate 139, on the exterior surface of which the radial ducts 150 are made. The outer edge of the annular plate 139 is connected to the band 142 via a vertical edge 140, the outside diameter of which is slightly smaller than the inside diameter of the lower edge of the body 114, so as to allow the body 114 to be force-fitted onto the intermediate member 132. The internal edge of the annular plate 139 is connected to a raised central portion 151, via an edge 152, the outside diameter of which is slightly smaller than the inside diameter of the central passage 118 so as to be forcibly inserted in the central passage. The raised central portion 151 has an orifice 134 at its center. The piece 153 is force-fitted onto a second piece 154 which at its centre has a bore for force-fitting onto the valve stem 103. There is a space 155 between the piece 152 and the piece 153, so as to form an expansion chamber for the product as it leaves the valve 105.

By actuating the valve, the product A leaves the valve stem 103, and emerges into the expansion chamber 155.

Some of the product A comes out under the central piston 131 via the orifice 134, so as to push an amount of product B towards the outlet orifice 351. Some of the product A directed into the central passage 118, passes into the annular region 115 through orifices or slits 157 located in the lower part of the central hollow tube 118. Thus two levels of flow towards the annular region are created. The orifices 157 may, after first use, be situated opposite the piston, and be uncovered after the piston has moved up by a certain axial height. At the same time, the other part of the product A passes into the radial ducts 150 between the intermediate piece 132 and the fixed bottom 116, and emerges in the annular region 115 via the slits or orifices 146. The product A leaves via the outlet orifice 350. In the same way as for the other embodiments, the possibilities of adjustment are infinite, for example, by altering the size, number and configuration of passages, orifices or other elements that make up the intermediate member 132.

In all these embodiments, the respective flow rates of the products A and B are also determined to some extent by the configuration of the outlet ducts for the products A and B. These outlet ducts may, by way of example, have restrictions or other elements capable of altering the emerging flow of products.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A dispenser for dispensing through at least one outlet at least two products, comprising:

a container for containing a first product;

a dispensing member extending from the container, the dispensing member being capable of being actuated to permit flow of the first product from the container;

an actuation control element, the actuation control element controlling actuation of the dispensing member and defining a reservoir for containing a second product, and first and second flow paths in flow communication with at least one outlet of the dispenser, the first flow path including at least one passage in flow communication with the dispensing member for conveying the first product, and the second flow path being in flow communication with the reservoir for conveying the second product, the reservoir being configured so that pressure of the first product flowing from the container causes flow of the second product through the second flow path; and a flow controlling member mounted between the dispensing member and the actuation control element, the flow controlling member being configured to regulate flow of the first and second products.

2. The dispenser of claim 1, wherein the actuation control element comprises a body formed of a single piece of molded thermoplastic.

3. The dispenser of claim 2, wherein the actuation control element further comprises a cap member on the body, the cap member including a surface capable of being pressed to provide actuation of the dispensing member, the at least one outlet of the dispenser being on the cap member.

4. The dispenser of claim 1, wherein the container contains a pressurized amount of the first product, and wherein the dispensing member comprises a valve.

5. The dispenser of claim 1, wherein the dispensing member comprises a manually actuated pump.

6. The dispenser of claim 1, wherein the reservoir has an annular shape, and wherein the passage of the first flow path is a central passage.

7. The dispenser of claim 1, wherein the actuation control element further comprises a fixed annular bottom wall including an orifice for providing flow communication with the dispensing member, and a movable piston defining a bottom of the reservoir, the piston being spaced from the bottom wall and the pressure of the first product being capable of moving the piston.

8. The dispenser of claim 7, wherein the actuation control element further comprises material bridges having a first end coupled to the bottom wall and a second end coupled to the passage of the first flow path, the bridges spacing the passage from the bottom wall.

9. The dispenser of claim 1, wherein the actuation control element is removable to permit refilling of at least one of the container and the reservoir.

10. The dispenser of claim 7, wherein the flow controlling member has an orifice in fluid communication with the dispensing member so that the first product flows into the passage of the first flow path and between the bottom wall and the piston.

11. The dispenser of claim 7, wherein the flow controlling member has an orifice in flow communication with the dispensing member, wherein the flow controlling member comprises a flow deflector and bridge sections spacing the flow deflector from the orifice of the flow controlling member, and wherein the first product flows, via openings between bridge sections, under the piston and into the passage of the first flow path.

12. The dispenser of claim 11, wherein the passage of the first flow path includes at least one of slits and orifices placing the passage in fluid communication with an annular region outside of the passage.

13. The dispenser of claim 12, wherein the piston covers the at least one of slits and orifices before the first dispensing of the products from the dispenser.

14. The dispenser of claim 7, wherein the flow controlling member has an orifice in flow communication with the dispensing member and a portion at least partially closing the orifice in the bottom wall of the actuation control element, wherein the bottom wall further includes openings, and wherein the first product flows, via a passage between the bottom wall and the flow controlling member and via the openings in the bottom wall, under the piston and into the passage of the first flow path.

15. The dispenser of claim 14, wherein the flow controlling member further comprises material bridges supporting the portion of the flow controlling member, and wherein the first product flows through passages between the material bridges.

16. The dispenser of claim 1, wherein the reservoir is in a central portion of the actuation control element and wherein the passage of the first flow path is an annular passage surrounding at least part of the reservoir.

17. The dispenser of claim 16, wherein a bottom of the actuation control element has at least one opening in flow communication with the annular passage, and wherein the flow controlling member has an orifice in flow communication with the dispensing member and at least one lateral passageway providing flow communication between the orifice in the flow controlling member and the opening in the bottom of the actuation control element, the first product flowing through the orifice in the flow controlling member being capable of pushing second product contained in the reservoir.

18. The dispenser of claim 17, wherein the passage of the first flow path includes at least one of slits and orifices providing flow communication between the passage and the central portion of the actuation control element.

19. The dispenser of claim 1, wherein the actuation control element is mounted on a cover band.

20. The dispenser of claim 19, wherein the flow controlling member and the cover band are a single piece of molded material.

21. The dispenser of claim 19, wherein frangible bridges of material connect the cover band to the actuation control element.

22. The dispenser of claim 1, wherein the container includes a pouch made of flexible material.

23. The dispenser of claim 22, wherein the container further includes a rigid or semi-rigid casing containing the pouch.

24. The dispenser of claim 1, wherein the first and second flow paths are in flow communication with a single outlet of the dispenser.

25. The dispenser of claim 24, further comprising an elastically deformable member movable in response to pressure of the first and second products between a first position closing the outlet of the dispenser and a second position permitting flow of the first and second products through the outlet.

26. The dispenser of claim 1, wherein the dispenser is configured to provide a ratio of the flow rate of the second product to the flow rate of the second product of from about 5/95 to about 50/50.

27. The dispenser of claim 26, wherein the dispenser is configured to provide a ratio of the flow rate of the second product to the flow rate of the second product of from 5/95 to 50/50.

28. The dispenser of claim 1, wherein the flow controlling member comprises a sleeve mounted on a hollow stem of the dispensing member, at least one of an internal surface of the sleeve and the external surface of the hollow stem including stirations capable of allowing air to escape from between the sleeve and the hollow stem.

29. The dispenser of claim 1, wherein the actuation control element is force fitted on the flow controlling member.

30. The dispenser of claim 1, wherein the container contains an amount of the first product and the reservoir contains an amount of the second product.

31. The dispenser of claim 30, wherein at least one of the first and second products is a cosmetic, pharmaceutical or dermopharmaceutical composition having a liquid to pasty consistency.

32. The dispenser of claim 30, wherein at least one of the first and second products is in the form of a gel, a cream, a gel-cream or a composition in the anhydrous phase.

33. The dispenser of claim 32, wherein the second product contains an active agent.

34. The dispenser of claim 33, wherein the active agent is vitamin A, C or E, bicarbonate, or a fruit acid.

35. The dispenser of claim 1, wherein the first flow path is in flow communication with a first outlet of the dispenser and the second flow path is in flow communication with a second outlet of the dispenser so that the first and second products are dispensed through different outlets.

36. The dispenser of claim 1, wherein the first product flows through the first flow path under pressure.

37. A unit for packaging and dispensing through at least one outlet at least two products packaged separately, comprising:

a first container containing a first product;

a dispensing member including an elastic return and a hollow stem mounted on the elastic return and extending from the first container, the dispensing member allowing the first product to flow from the first container via the hollow stem;

an actuation control element for controlling actuation of the dispensing member, the actuation control element including a body having a reservoir containing a second product capable of leaving the reservoir via a first orifice in response to pressure of the first product, and at least one passage in flow communication with the hollow stem for conveying the first product under pressure toward a second orifice; and a flow controlling member mounted between the hollow stem and the actuation control element, the flow controlling member being configured to interact with the flow of the first product to determine the respective outlet flow rates of the first and second products.

* * * * *